US010569285B2

(12) United States Patent
Dambricourt

(10) Patent No.: US 10,569,285 B2
(45) Date of Patent: Feb. 25, 2020

(54) LEAKTIGHT NON-RETURN VALVE

(71) Applicant: CEP TUBES, Saint-Remy-sur-Durolle (FR)

(72) Inventor: Géry Dambricourt, Escoutoux (FR)

(73) Assignee: CEP TUBES, Saint-Remy-sur-Durolle (FR)

( * ) Notice: Subject to any disclaimer, the term of this patent is extended or adjusted under 35 U.S.C. 154(b) by 0 days.

(21) Appl. No.: 15/762,549

(22) PCT Filed: Sep. 22, 2016

(86) PCT No.: PCT/FR2016/052406
§ 371 (c)(1),
(2) Date: Mar. 22, 2018

(87) PCT Pub. No.: WO2017/051125
PCT Pub. Date: Mar. 30, 2017

(65) Prior Publication Data
US 2019/0076862 A1 Mar. 14, 2019

(51) Int. Cl.
*B05B 11/00* (2006.01)
*B65D 47/20* (2006.01)

(52) U.S. Cl.
CPC ..... *B05B 11/007* (2013.01); *B05B 11/0072* (2013.01); *B05B 11/0075* (2013.01); *B05B 11/3001* (2013.01); *B05B 11/3069* (2013.01); *B05B 11/3074* (2013.01); *B65D 47/2031* (2013.01)

(58) Field of Classification Search
CPC ..... B05B 11/007; B05B 11/0075; B05B 11/0072; B05B 11/3001; B05B 11/3069; B05B 11/3074; B65D 47/2031
See application file for complete search history.

(56) References Cited

U.S. PATENT DOCUMENTS 5,465,872 A * 11/1995 Gueret ..... B05B 11/0005 222/95
5,704,522 A * 1/1998 Orgeolet ..... B67D 7/44 222/494

(Continued)

FOREIGN PATENT DOCUMENTS

| | | |
|---|---|---|
| EP | 1702862 A2 | 9/2006 |
| EP | 1702862 A3 | 8/2009 |
| FR | 2895734 A1 | 7/2007 |

OTHER PUBLICATIONS

International Search Report and Written Opinion for PCT Patent App. No. PCT/FR2016/052406 (dated Jan. 24, 2017) in English.

*Primary Examiner* — Jeremy Carroll
(74) *Attorney, Agent, or Firm* — Kenealy Vaidya LLP

(57) ABSTRACT

Some embodiments are directed to a valve made up of a rigid wall and a flap. The flap has a non-perforated flexible and deformable peripheral region situated facing the rigid wall. The rigid wall is perforated by at least one orifice situated facing the peripheral region. The flap is joined to the rigid wall by a non-deformable fixed connection. The peripheral region has a substantially conical shape before mounting with a large base and a small base and an inner face on the inner side of the cone. The peripheral region exhibits a deformation following the pressing of the inner face of the large base against the rigid wall in a assembled position.

19 Claims, 5 Drawing Sheets

(56) References Cited

U.S. PATENT DOCUMENTS

| | | | | |
|---|---|---|---|---|
| 2003/0168475 | A1* | 9/2003 | Heukamp | B05B 11/007 222/207 |
| 2011/0042419 | A1* | 2/2011 | Hodson | A61M 15/009 222/402.2 |
| 2014/0305971 | A1* | 10/2014 | Goettke | B05B 11/3001 222/380 |

* cited by examiner

LEAKTIGHT NON-RETURN VALVE

CROSS REFERENCE TO RELATED APPLICATIONS

This application is a national phase filing under 35 C.F.R. § 371 of and claims priority to PCT Patent Application No. PCT/FR2016/052406, filed on Sep. 22, 2016, which claims the priority benefit under 35 U.S.C. § 119 of French Patent Application No. 1560099, filed on Oct. 22, 2015, and French Patent Application No. 1558944, filed on Sep. 22, 2015, the contents of each of which are hereby incorporated in their entireties by reference.

BACKGROUND

Some embodiments relate to a valve equipping the non-return pump of an airless dispensing system, i.e., one without air intake, such that the product dispensed is never in contact with the air before it is dispensed. This type of airless dispensing system is used to dispense products which are liable to deteriorate in contact with the air. They may be, for example, pharmaceutical products, cosmetic products such as care creams with a fluid, i.e., liquid or pasty, consistency. Since there is a desire to eliminate preservatives in creams, it is necessary to protect them from the air. The fluid product is thus packaged in a retractable container such that the volume of the container corresponds precisely to the remaining quantity of product it contains at any time of use, the product never being in contact with the air inside the container.

A related art dispenser includes a pump equipped with an inlet valve and an outlet valve. It is connected to the container in a leaktight manner and has, at the outlet of the pump, an evacuation duct that opens out at an orifice, the pump being actuated by a push button. The leaktightness of the valves equipping the pump is essential to allow proper operation of the pump and to ensure the airtightness of the dispensing system. In order to meet this objective, the valves of the pumps are usually formed by complex elements incorporating balls or flaps, both of which are able to move, guides, presser of the spring type for pressing, opening and closing stops, etc. These complex systems ensure the leaktightness of the valve when it is in the closed position and more particularly when the dispensing system is at rest. The dispensing system is at rest when the pressures inside the container and inside the pump and atmospheric pressure are identical. The inlet and outlet valves of the pump are then closed and airtight.

Furthermore, creams are increasingly water-based emulsions and the containers in which the cream is packaged are by definition closed in a leaktight manner. The water of these emulsions tends to turn into water vapour when it is enclosed in a closed container and when the temperature is greater than 0° C. The change of the water from the liquid phase to the gaseous phase creates an overpressure in the container. It is essential, when the pump is at rest, that the valves be leaktight in spite of the overpressure inside of the container with respect to atmospheric pressure.

The related art pumps which equip the airless dispensing systems are thus generally complex, sometimes fragile, and made up of a large number of parts, this complicating manufacturing and increasing the cost, especially since these components are generally miniaturized.

SUMMARY

The complexity of the traditional valves comes from the fact that they employ moving flaps and ensure good leaktightness when they are closed.

Although fixed flaps exist, which are simpler to employ than moving flaps, these flaps are never used in airless dispensing systems since they do not ensure airtightness when the system is at rest, mainly because the constituent parts of the valve that shut it off do not press against one another or press poorly against one another. This critical defect is amplified further on account of the overpressure inside the container with respect to atmospheric pressure.

Some embodiments are therefore directed to a valve for a non-return pump which is reliable, simple and inexpensive to manufacture, this valve being perfectly airtight in the closed position.

The valve according to some embodiments includes a rigid wall and a flap, wherein:

- the flap has a non-perforated flexible and deformable peripheral region situated facing the rigid wall,
- the rigid wall is perforated by at least one orifice situated facing the peripheral region,
- the valve is in a closed position when the peripheral region of the flap is in contact with the rigid wall around its entire perimeter and in an open position when the peripheral region of the flap is away from the rigid wall on at least a part of its perimeter, the flap and the rigid wall forming a leaktight assembly when the peripheral region is in contact with the rigid wall on its entire perimeter,
- the flap is joined to the rigid wall by a non-deformable fixed connection,
- the valve passes from the closed position to the open position by deformation of the peripheral region of the flap, and
- all the points of the peripheral region that are in contact with the rigid wall press against the rigid wall, the pressing being obtained by elastic deformation of the peripheral region, the deformation resulting from the assembly of the flap and the rigid wall.

In the present description, "the flap is joined to the rigid wall by a non-deformable fixed connection" means that only a part of the flap ensuring the connection to the rigid wall is fixed and non-deformable. This fixed part, made of flexible polymer, is situated at the centre of the flap. The flexible peripheral region extends radially outwards from this fixing zone.

The fixing zone may, for example, be made up of a flexible hollow shaft that is part of the flap and fitted on a rigid stem joined to the rigid wall. The assembly of the flexible hollow shaft and the rigid stem forms a fixed, non-deformable and leaktight connection. The assembly thus produced can withstand an upstream overpressure greater than 6 bar.

Thus, in the assembled position, the fixing zone cannot carry out any movement in translation, in rotation or in deformation of any type with respect to the rigid wall.

The flap forms the only region for the product to pass between the container and the pump or between the pump and the outside. The combination of the perforated rigid wall with the flexible wall closing the orifice of the rigid wall by elastic deformation of the flexible wall makes it possible to have precise leaktight closure, which is resistant and flexible. Specifically, the flexible wall presses, that is to say is compressed, against the rigid wall.

The dispensing system and the container delimit three spaces, the container, the pump and the outside. These three spaces are isolated from one another by leaktight barriers formed by the inlet valve and the outlet valve of the pump. The container is a space situated upstream of the pump and the pump is a space situated upstream of the outside with respect to the direction of flow of the product. The valve according to some embodiments is perfectly closed and leaktight when the pressures in the container, in the pump, and on the outside are approximately identical. Moreover, one or the other of the valves of some embodiments remains closed and leaktight for as long as the overpressure in an upstream space with respect to the downstream space which is contiguous therewith is less than a threshold previously fixed at the choice of the user industry.

For example, the valve remains closed and leaktight when the overpressure in the upstream space is less than 40 millibar, preferably less than 100 to 200 millibar, than that in the downstream space which is contiguous therewith. Above this minimum overpressure, the flexible wall of the flap deforms. The valve is then in an open position and opens up the passage from the upstream space to the downstream space.

The value of the overpressure in the upstream space for opening the flap may be varied depending on the nature of the polymer, on the thickness of the wall of the peripheral region, and on the diameter of the valve. The rigid wall may have a plurality of orifices. The system is leaktight after 60 days in an oven at 55° C.

Advantageously, the peripheral region of the flap has a substantially conical shape before mounting, with a large base and a small base and an inner face on the inner side of the cone. In an assembled position, the peripheral region has a deformation of the flattening type, causing elongation following the pressing of the inner face of the large base against the rigid wall. The flexible wall has a flattened region on the side of the large base, forming the region of contact with the rigid wall. Before deformation, the peripheral region thus has a substantially frustoconical shape. For example, the small base has a diameter of 3.34 mm and the large base has a diameter of 5.67 mm, the wall making an angle of 45° with the axis of revolution of the cone frustum and having a thickness of 0.50 mm. After deformation, the peripheral region is compressed in the form of a "squashed" cone frustum, the outside diameter of the ring changing from 5.67 mm to around 6.20 mm, i.e., an elongation of the material of around 9%. This elongation results from the flexible wall pressing on its large base on the side of its internal face. This elongation causes a considerable pressing force, much greater than a non-elastic deformation, which ensures the leaktightness "at rest" and at the overpressure of the upstream space.

Advantageously, the flap is made in one piece of elastic polymer with shape memory. The deformation of the polymer causes preloading in the peripheral region of the flap, which keeps it pressing against the rigid wall when it is in the closed position.

Advantageously, the flap is joined to the rigid wall by a fixer disposed inside the peripheral region. Since the fixed connection between the rigid wall and the flap is situated in the central part of the flap, the surface of the deformable region is strictly homogeneous, thereby ensuring the homogeneity of pressing at all points equidistant from the centre of the flap.

Advantageously, the flap is circular and the peripheral region annular. This shape is the easiest to produce. The flap may have some other shape.

Advantageously, the fixer is formed by a stem or a hollow cylinder joined fixedly to the rigid wall and by a hollow shaft disposed at the centre of the flap, the hollow shaft being fitted on the stem or the hollow cylinder. The material of the hollow shaft and the retained assembly system ensure the leaktightness of the fixer. The assembly thus produced can withstand an upstream overpressure greater than 6 bar.

Advantageously, the stem or the hollow cylinder and the rigid wall are part of a one-piece part. The number of parts required to produce the pump is thus reduced.

Some embodiments also relate to a device of the pump type including an inlet valve and an outlet valve, wherein at least one first valve with at least one of the above features is disposed at an inlet and/or at an outlet of the device. The pump is thus simple and all the easier to manufacture since the rigid walls are each part of a constituent one-piece part of the structure of the pump.

Advantageously, the device includes two valves having an identical flap. This standardization allows the manufacturing costs to be reduced.

Some embodiments also relate to a device of the airless flexible tube type having a nozzle, wherein the nozzle includes a valve with at least one of the above features that is housed in the orifice of the flexible tube. The flexible tube is another type of container, the volume of which is able to correspond, at any moment of its use, to the remaining volume of product that it contains. In a traditional mode of use, the orifice of the tube is open and when the user releases the pressure on the wall of the tube, air passes into the tube, completely or partially replacing the cream evacuated. During use, there is thus a large quantity of air in the tube, especially when the wall of the tube is provided with significant shape memory, which is often the case for tubes used to package care creams. In this second exemplary embodiment, the nozzle of the flexible tube includes a valve of some embodiments closing the orifice of the flexible tube. Thus, when the user presses on the flexible wall of the tube, the overpressure created in the tube opens the valve and opens up the passage through the orifice of the tube. As soon as he interrupts this pressure, the valve closes again, preventing the penetration of air into the tube. This application of some embodiments is thus highly advantageous in that it makes it possible to have an airless package without employing a pump, which is more expensive than the device of some embodiments, and moreover has ergonomics that are ill-suited to joining to a container of the flexible tube type.

Advantageously, the nozzle is covered by a second flexible flap for shutting off the orifice, the second flap being fixed to the internal face of a hollow shaft pressing against the free end of a stem, the stem and the hollow shaft being in one piece with a support part. The flexible tube thus has two barriers to the entry of air into the tube, the two barriers being disposed "in series" with one another: the flexible flap for shutting off the orifice and the flap of the non-return valve open and close the passage at the same time depending on whether the user exerts a pressure on the wall of the tube or interrupts this pressure.

Advantageously, the support part forms a one-piece assembly with the nozzle. This embodiment is particularly economical since the rigid pressing walls and the fixer for fixing each flap are realized in the one-piece nozzle.

BRIEF DESCRIPTION OF THE FIGURES

Further advantages may also become apparent to a person of ordinary skill in the art from reading the following examples, illustrated by the appended figures, which are given by way of example.

DETAILED DESCRIPTION OF EXEMPLARY EMBODIMENTS

The leaktight non-return valve of some embodiments fits on a first device of the pump type equipping an airless dispensing system (airless dispenser).

In the rest of the description, the side on which the lid is situated will be called the top and the side on which the container is situated will be called the bottom.

Figure 1:
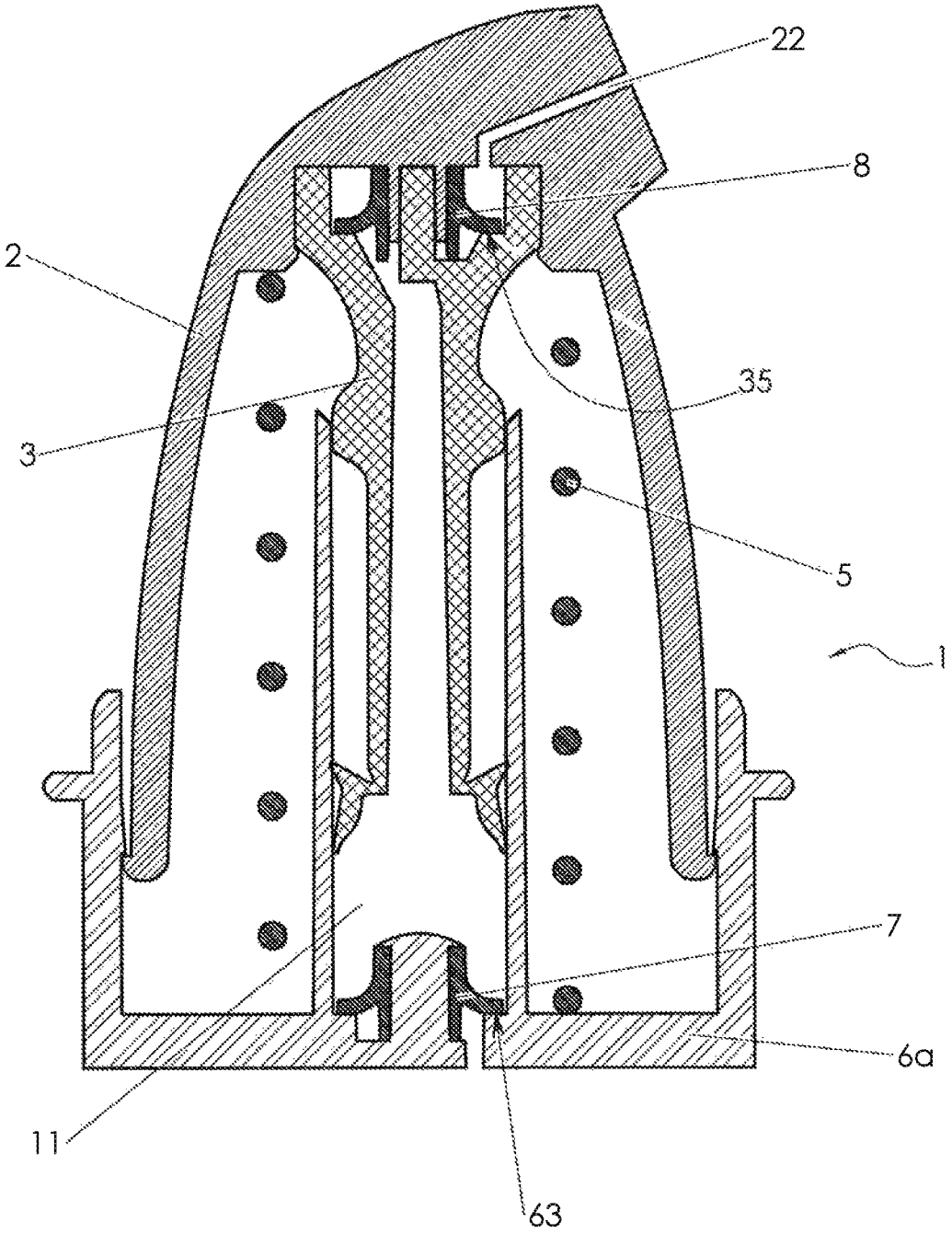
FIG. 1 is a cross section through an airless dispensing system of which the pump is equipped with an inlet valve and an outlet valve according to some embodiments.
Figure 2:
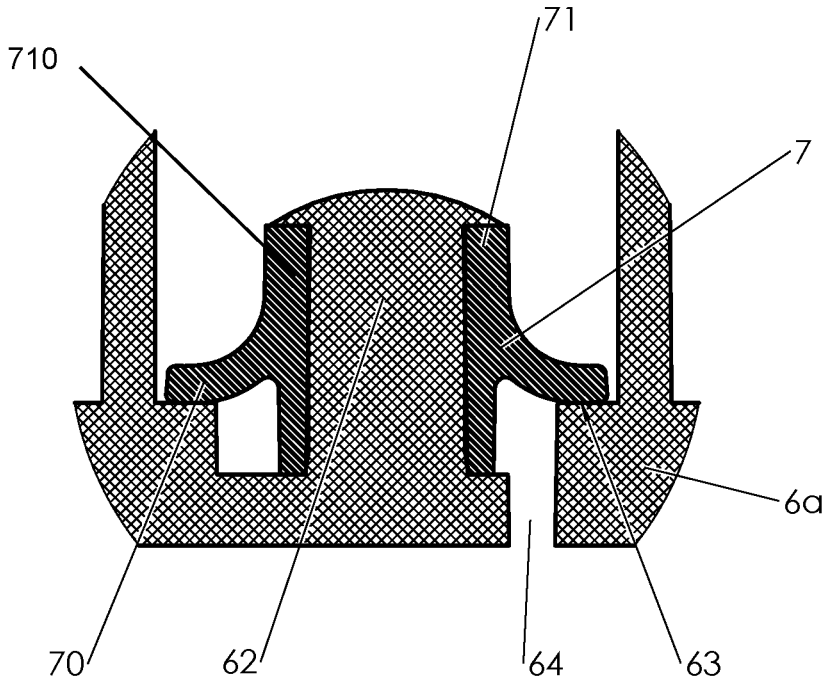
FIG. 2 is a cross section through the valve according to some embodiments in a first disposition.
Figure 3:
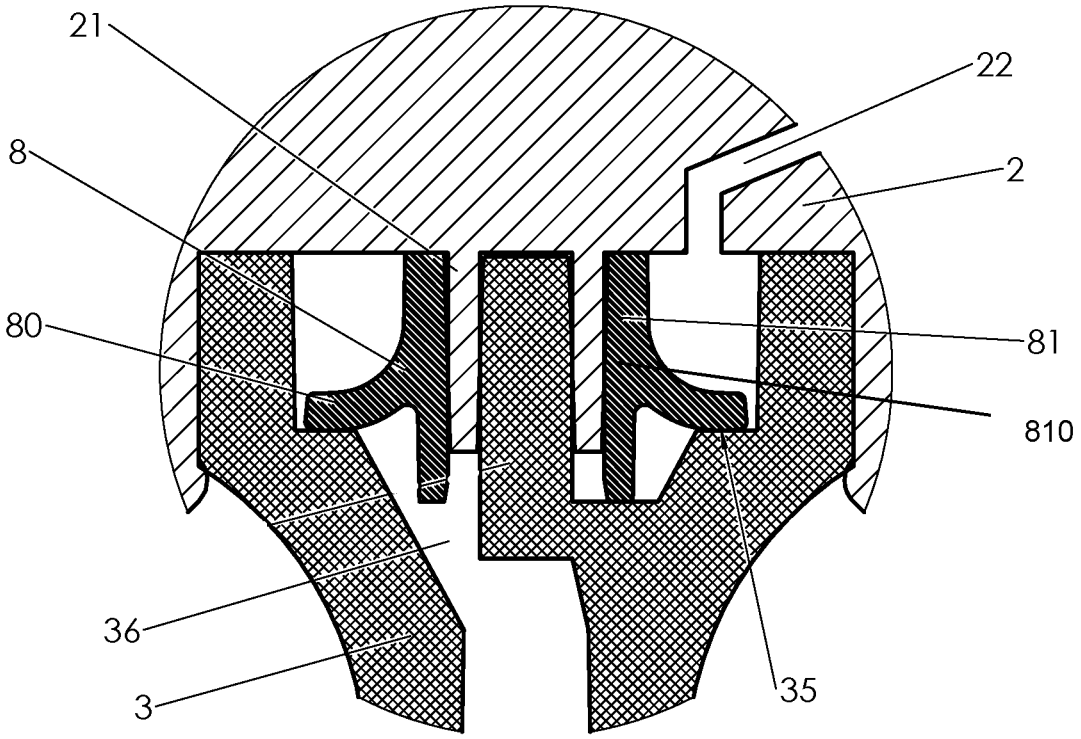
FIG. 3 is a cross section through the valve according to some embodiments in a second disposition.

The airless dispenser in FIG. 1 includes a push button 2 and a pump 1, made up of a first element 6*a* and a second element 3, which are movable with respect to one another, the combination of these two elements making it possible to form a closed space of variable volume forming a dispensing chamber 11. The dispenser is fixed to a container (not shown) disposed on the opposite side from the push button 2.

The pump 1 is equipped with an inlet valve made up of a flap 7 pressing against the rigid wall 63 belonging to the first element 6*a* of the pump 1, and an outlet valve made up of a flap 8 pressing against the rigid wall 35 belonging to the second element 3 of the pump 1.

The inlet valve ensures the barrier between the container and the pump 1, the outlet valve ensures the barrier between the pump 1 and the outside, thus delimiting three spaces, which are leaktight with respect to one another, of the container, of the pump and of the outside atmosphere.

Figure 4:
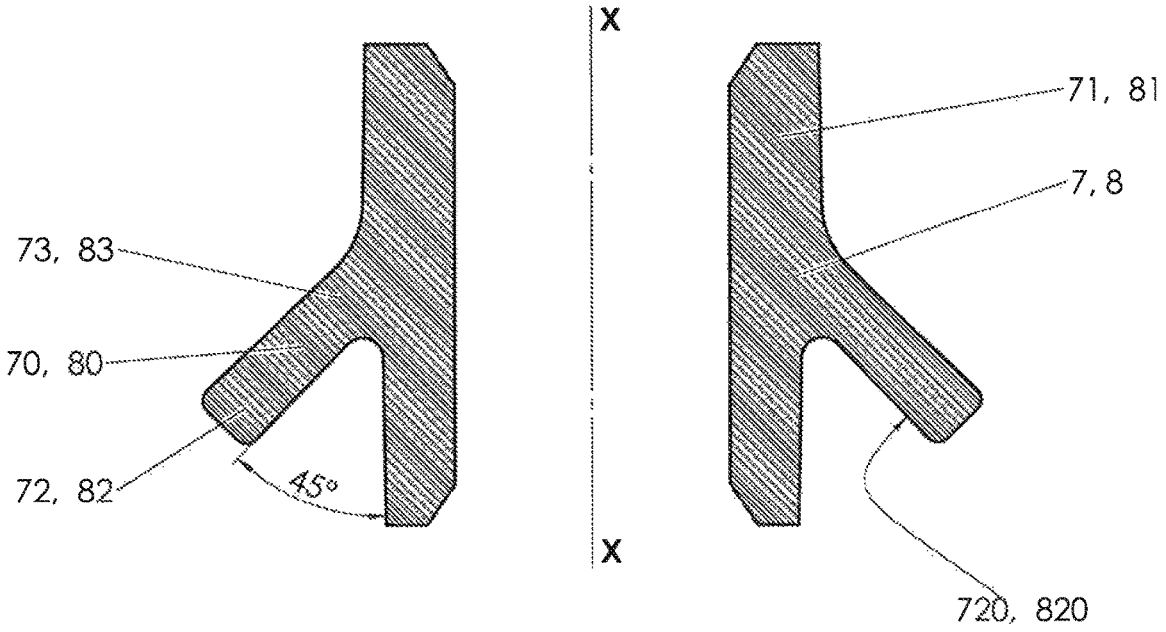
FIG. 4 is a cross-sectional view of the flap according to some embodiments before mounting.

The flap 7 includes a flexible peripheral wall 70 and a central fixer formed by a hollow shaft 71. Before assembly, the flexible wall 70 describes a cone of revolution of axis XX, the generatrix of which is approximately a straight line that forms an angle A with the axis XX of the hollow shaft 71, for example 45° (FIG. 4). The value of the angle A can vary depending on the polymer and on the diameter of the flap 7. The preferred angle A combines the greatest pressing area and the greatest pressing force after assembly.

The assembly covers pressing the flap 7 against the wall 63, by fitting the hollow shaft 71 on a stem 62 that also belongs to the first element 6*a* of the pump and is substantially perpendicular to the wall 63. This assembly is a non-deformable fixed connection 710.

Figure 5:
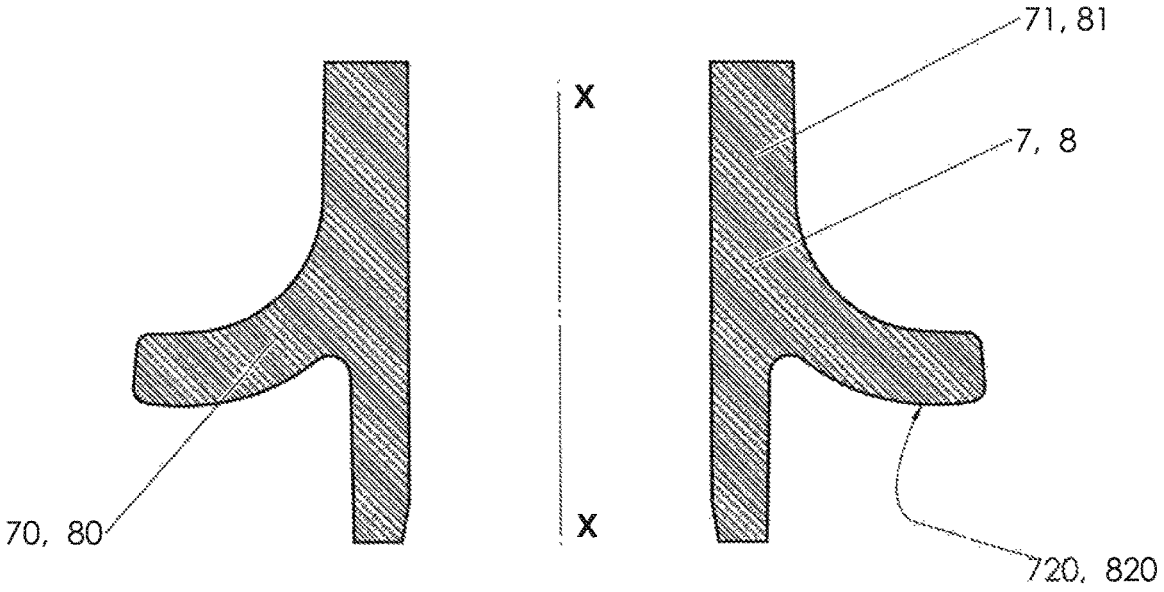
FIG. 5 is a cross-sectional view of the flap in FIG. 4 compressed after mounting.

The cone of revolution has a large base 72 and a small base 73, and an inner face 720 on the inner side of the cone. Once the flap 7 is assembled in the pressing position, i.e., after squashing, the flap 7 describes an axisymmetric shape, the generatrix of which is approximately a quarter of a circle, the outer end of the peripheral region 70 describing a flattened ring (cf. FIG. 5) and pressing against the rigid wall 63, the large base 72 being deformed by the pressing of its inner face 720 against the rigid wall 63. The outside diameter of the large base changes from 5.67 mm to around 6.20 mm, i.e., an elongation of the material of around 9%. This elongation causes a considerable pressing force, much greater than a non-elastic deformation, which ensures leaktightness "at rest".

The rigid wall 63 is pierced by at least one orifice 64 that is disposed under the flap 7 and allows the outlet of the product from the container. The flexible peripheral region 70 ensures leaktightness up to an overpressure of the upstream region of between 120 and 160 millibar, above which the region 70 will deform in order to open the valve and allow the product to pass through. This value is both sufficient to ensure the leaktightness of the valve and sufficiently low to be comfortable for the user.

The outlet flap 8 of the pump has the same features before and after assembly as the flap 7. It has a flexible wall 80 and a hollow shaft 81. The cone of revolution has a large base 82 and a small base 83, and an inner face 820 on 30 the inner side of the cone. In a preferred solution, it is strictly identical to the flap 7. After assembly, the flexible wall 80 is pressed against a rigid wall 35 belonging to the second constituent element 3 of the pump, with identical features to the pressing of the flexible wall 70 against the rigid wall 63. The hollow shaft 81 is fitted on a hollow stem 21 substantially perpendicular to the wall 35 which is perforated by at least one orifice 36 disposed under 5 the flap 8. This fitting is a non-deformable fixed connection 810.

The outlet valve thus has identical properties to the inlet valve.

The push button 2 is pierced by a duct 22 which allows the product to be dispensed.

The mode of operation of the pump will now be described. At rest, the two valves are closed, the two flaps are pressed against the rigid walls 63 and 35, and the second element 3 of the pump 1 and the push button 2 are fixedly connected.

The push button 2 is able to move. The back and forth movement of the push button 2 causes a variation in the volume of the variable-volume dispensing chamber 11. When the user presses on the push button 2, he compresses the dispensing chamber 11 and creates an overpressure in the dispensing chamber 11. The overpressure causes the flap 8 of the outlet valve to open, the volume in the dispensing chamber to reduce, and the product to be evacuated to the outside. When the user releases the push button 2, the latter rises again under the effect of a returner 5 and creates a negative pressure in the dispensing chamber 11. The negative pressure causes the flap 8 of the outlet valve to close, the flap 7 of the inlet valve to open, and the dispensing chamber 11 to be refilled from the container (not shown).

The leaktight non-return valve of some embodiments fits on a second device of the flexible tube type.

Figure 6C:
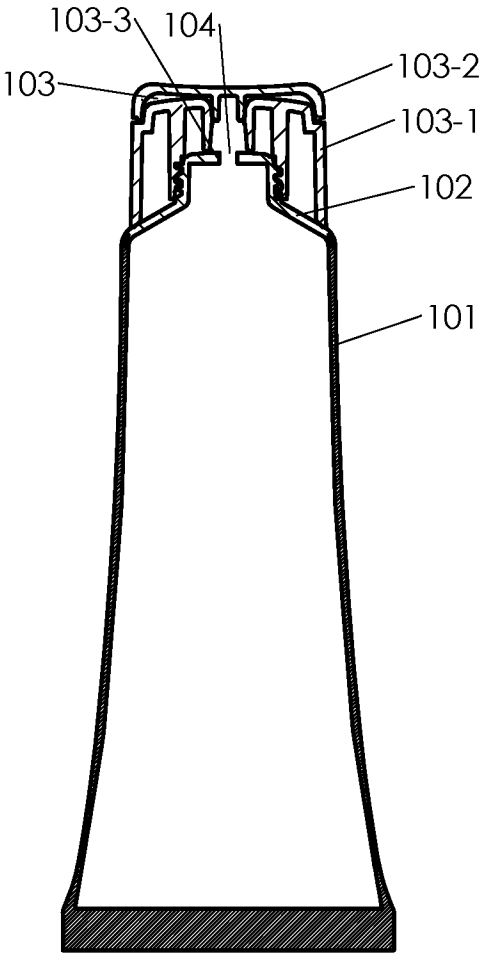
FIGURE 6C Related Art
FIGS. 6A, 6B, 6C are cross-sectional views of a flexible tube of the related art, without a lid, equipped with a removable "screw"-type lid, and equipped with a fixed lid known as a "flip-top lid", respectively.
Figure 6B:
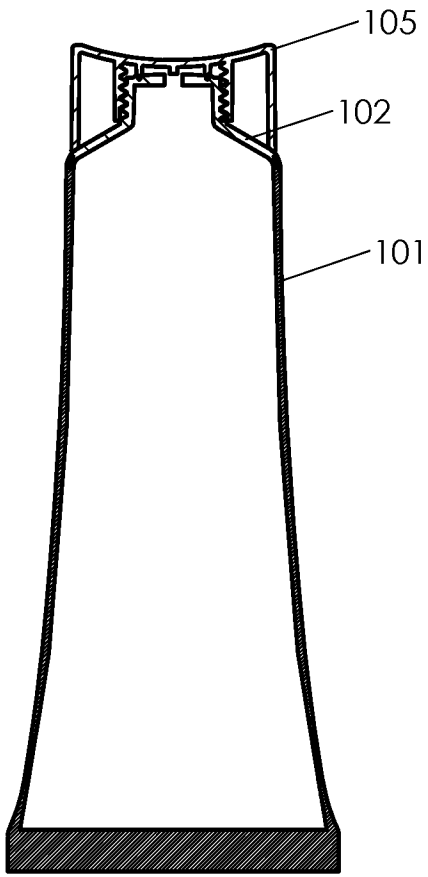
FIGURE 6B Related Art
Figure 6A:
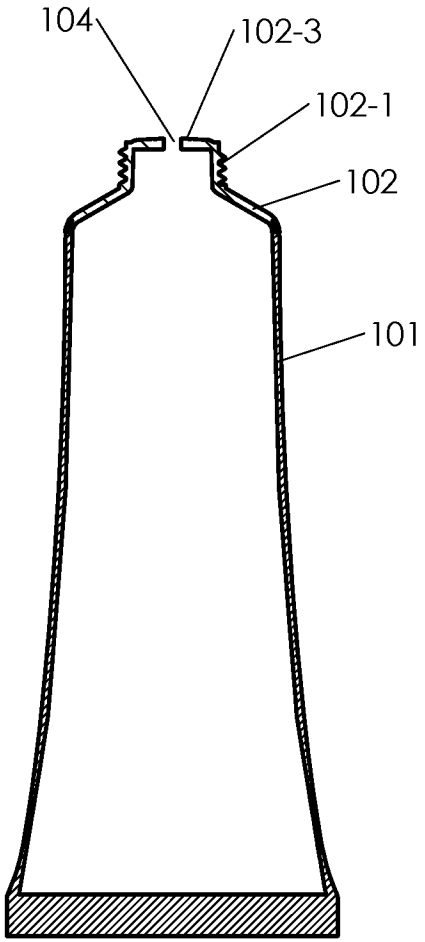
FIGURE 6A Related Art

As can be seen in FIGS. 6A, 6B and 6C, the flexible tubes are generally made up of three constituents: a flexible body or skirt 101, a tube head 102 and a cap. The head of the tube is a rigid element having a fixer 102-1 for the cap, the cap being able to be fixed, in the case of the "flip-top" cap 103 (FIG. 6C), or removable, in the case of the "screw" cap 105 (FIG. 6B).

When the tube is equipped with a removable cap 105, the head of the tube 102 forms a one-piece assembly incorporating the fixer 102-1 of the removable cap 105 and the nozzle 102-3, which delimits the evacuation orifice 104 for the product contained in the tube. The orifice 104 is closed by screwing the cap 105 onto the fixer 102-1.

The fixed caps 103 are made up of two parts:

A first part, referred to as base 103-1, is permanently fixed to the tube by the fixer 102-1; and A second part, referred to as cover 103-2, is fixed to the base 103-1 by a hinge.

In this arrangement, the nozzle 103-3 delimiting the orifice 104 of the tube is in one piece with the base of the cap. The cover is free to pivot with respect to the base. In the open position, it opens up the orifice 104, and in the closed position, it closes the orifice 104.

The flexible tube according to some embodiments includes a valve housed in the orifice 104. The support part **6*b* is a one-piece assembly which combines the stem 62, the hollow shaft 106, and the rigid wall 63 (cf. FIGS. 7 and 8). The support part 6*b* may be assembled together with the nozzle 102-3, 103-3**.

The support part **6*b* may be an element of the one-piece nozzle 102-3, 103-3**.

Figure 7:
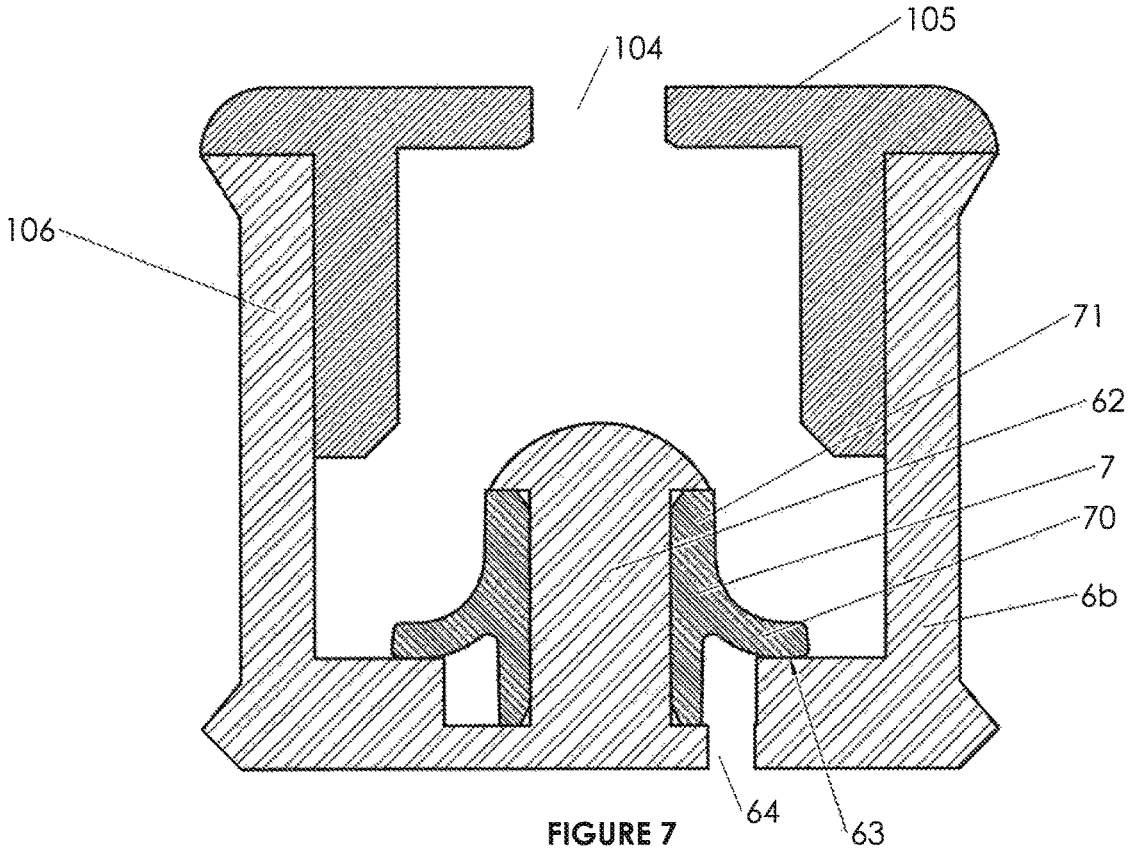
FIG. 7 is a cross section through the valve according to some embodiments which is covered with a reducer and disposed on a flexible tube.

In a first variant, shown in FIG. 7, the nozzle is covered by a reducer 105 for protecting the flap 7 and giving the outlet orifice 104 the required diameter. The reducer 105 is fixed to the support part **6*a* in the hollow shaft 106**.

Figure 8:
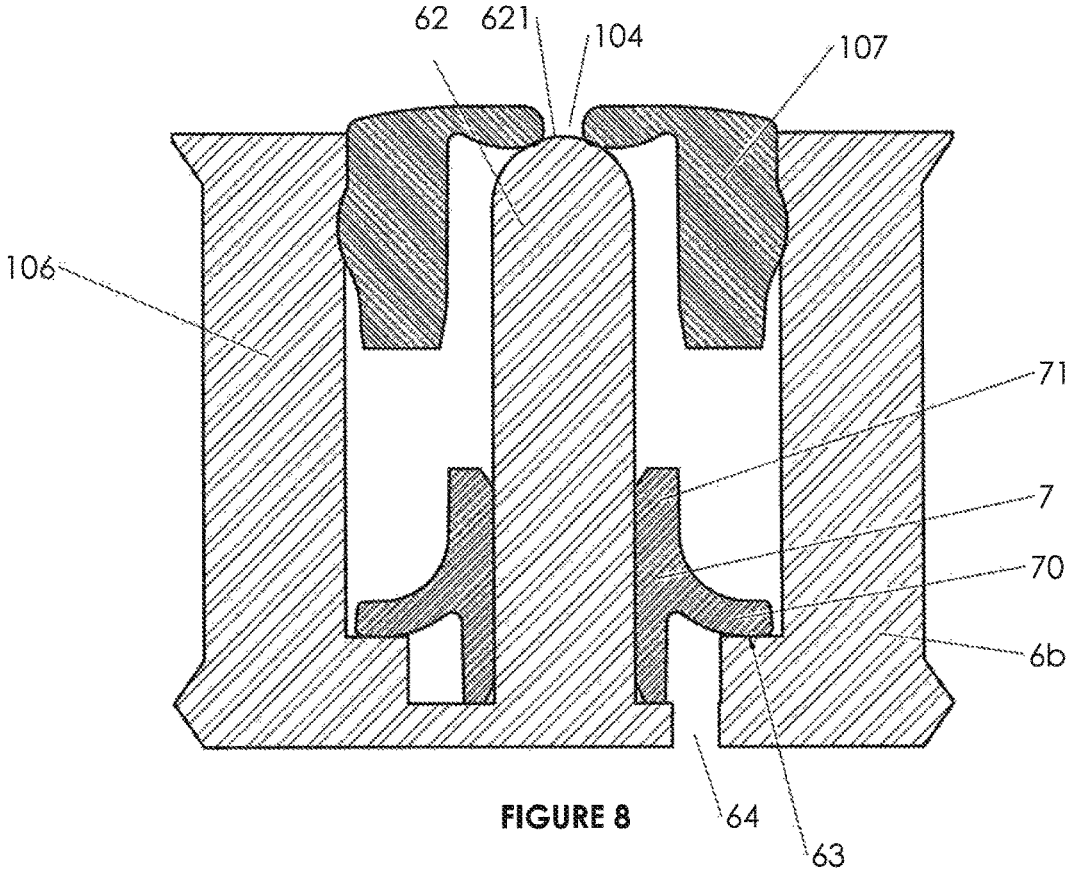
FIG. 8 is a cross section through the valve according to some embodiments which is covered with a second flexible shut-off flap and disposed on a flexible tube.

In the second variant, shown in FIG. 8, the nozzle is covered by a second flexible flap 107 for shutting off the orifice 104 instead of the reducer 105 in FIG. 7. The second flap 107 is fixed to the internal face of the hollow shaft 106, pressing against the free end 621 of the stem 62. The valve forming the shut-off nozzle and the non-return valve open and close simultaneously depending on whether the user exerts a pressure on the wall of the tube or interrupts this pressure.

The free end of the stem 62 and the wall 106 act as a rigid pressing wall and as a fixer for the flap 107, respectively.

This embodiment is particularly economical since the fixer for fixing the flaps 7 and 107, and the rigid pressing walls of these flaps, are produced from the one-piece part **6*a***.

The flap 7 or 8 may be made of an elastomer of the SEBS, TPP or TEV type. The rigid wall 63, 35 may be made of high-density polyethylene (HDPE), polycarbonate (PC), polypropylene (PP) or styrene acrylonitrile (SAN) and of any type of rigid polymer compatible with the packaged product.

The invention claimed is:

1. An airtight valve, comprising:

a rigid wall; and a flap that has a non-perforated flexible and deformable peripheral region situated facing the rigid wall, the rigid wall being perforated by at least one orifice situated facing the peripheral region, the flap being joined to the rigid wall by a non-deformable fixed connection, the peripheral region having a conical shape before mounting with a large base and a small base and an inner face on the inner side of the cone, the peripheral region exhibiting a deformation of the flattening type, causing elongation following the pressing of the inner face of the large base against the rigid wall in an assembled position.

2. The valve according to claim 1, wherein the flap is made in one piece of elastic shape memory polymer.

3. The valve according to claim 2, wherein the flap is joined to the rigid wall by a fixing device disposed inside the peripheral region.

4. A pump type device, comprising:

an inlet valve; and an outlet valve, at least one of the inlet valve and the outlet valve including the valve of claim 2.

5. An airless flexible tube type device, comprising:

a nozzle with the orifice, the nozzle including the valve according to claim 2.

6. The valve according to claim 1, wherein the flap is joined to the rigid wall by a fixing device disposed inside the peripheral region.

7. The valve according to claim 6, wherein the fixing device is formed by a stem or a hollow cylinder joined fixedly to the rigid wall and by a hollow shaft disposed at the center of the flap, the hollow shaft being fitted on the stem or the hollow cylinder.

8. The valve according to claim 7, wherein the stem or the hollow cylinder and the rigid wall are part of a one-piece part.

9. A pump type device, comprising:

an inlet valve; and an outlet valve, at least one of the inlet valve and the outlet valve including the valve of claim 8.

10. An airless flexible tube type device, comprising:

a nozzle with the orifice, the nozzle including the valve according to claim 8.

11. A pump type device, comprising:

an inlet valve; and an outlet valve, at least one of the inlet valve and the outlet valve including the valve of claim 7.

12. An airless flexible tube type device, comprising:

a nozzle with the orifice, the nozzle including the valve according to claim 7.

13. A pump type device, comprising:

an inlet valve; and an outlet valve, at least one of the inlet valve and the outlet valve including the valve of claim 6.

14. An airless flexible tube type device, comprising:

a nozzle with the orifice, the nozzle including the valve according to claim 6.

15. A pump type device, comprising:

an inlet valve; and an outlet valve, at least one of the inlet valve and the outlet valve including the valve of claim 1.

16. The device according to claim 15, wherein the inlet and outlet valves have an identical flap.

17. An airless flexible tube type device, comprising:

a nozzle with the orifice, the nozzle including the valve according to claim 1.

18. The device according to claim 17, wherein the nozzle is covered by a second flexible flap for shutting off the orifice, the second flexible flap being fixed to an internal face of a hollow shaft pressing against the free end of a stem, the stem and the hollow shaft being in one piece with a support part.

19. The valve according to claim 1, wherein the flap after deformation, the peripheral region of the flap is compressed in the form of a "squashed" cone frustum, the outside diameter of the ring has an elongation of the material of around 9%.

* * * * *